US008049702B2

(12) United States Patent
Miyazawa et al.

(10) Patent No.: US 8,049,702 B2
(45) Date of Patent: Nov. 1, 2011

(54) LOW POWER DISPLAY DEVICE

(75) Inventors: Toshio Miyazawa, Chiba (JP); Katsumi Matsumoto, Mobara (JP); Kozo Yasuda, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 1031 days.

(21) Appl. No.: 11/491,191

(22) Filed: Jul. 24, 2006

(65) Prior Publication Data

US 2007/0024566 A1 Feb. 1, 2007

(30) Foreign Application Priority Data

Jul. 27, 2005 (JP) ..... 2005-219896

(51) Int. Cl.
*G09G 3/36* (2006.01)

(52) U.S. Cl. ..... 345/98; 345/99; 345/100

(58) Field of Classification Search ..... 345/100, 345/93–94, 96, 98–99; 349/33–34
See application file for complete search history.

(56) References Cited

U.S. PATENT DOCUMENTS 5,712,652 A * 1/1998 Sato et al. ..... 345/90
5,959,598 A * 9/1999 McKnight ..... 345/90
7,057,596 B2 6/2006 Miyazawa
2001/0052890 A1* 12/2001 Miyazawa et al. ..... 345/89
2002/0036625 A1* 3/2002 Nakamura ..... 345/204

FOREIGN PATENT DOCUMENTS

| | | |
|---|---|---|
| JP | 2002-169137 | 6/2002 |
| JP | 2002-207453 | 7/2002 |
| JP | 2002-229532 | 8/2002 |
| JP | 2003-302946 | 10/2003 |
| JP | 2004-252307 | 9/2004 |

* cited by examiner

*Primary Examiner* — Sumati Lefkowitz
*Assistant Examiner* — Jonathan Horner
(74) *Attorney, Agent, or Firm* — Stites & Harbison PLLC; Juan Carlos A. Marquez, Esq.

(57) ABSTRACT

A display device which is used in a miniaturized portable information device can exhibit the low power consumption even when a display is not changed over for a long period in a state that a battery or the like is used as a power source. The display device can maintain a high numerical aperture by suppressing the number of parts even when a memory element is provided to a pixel. In a liquid crystal display device, a pixel exhibits the low power consumption by including a memory element and thus preventing the transmission of a video signal. By making use of a charge held in a pixel electrode of a liquid crystal display panel, a signal for AC driving is formed in the inside of a pixel thus performing AC driving to perform a display without deteriorating liquid crystal even when the video signal is not rewritten. The liquid crystal display device can realize the memory element with the simple constitution without sacrificing a numeral aperture.

6 Claims, 13 Drawing Sheets

LOW POWER DISPLAY DEVICE

BACKGROUND OF THE INVENTION

1. Field of the Invention

The present invention relates to an active-matrix-type display device, and more particularly to a display device which has a pixel-memory with a high aperture ratio and high definition.

2. Description of the Related Art

A liquid crystal display device of a TFT (Thin Film Transistor) type which includes a switching element in each pixel portion has been popularly used as a display device of a personal computer or the like. Further, the TFT-type display device is also used as a display device of a portable information device such as a mobile phone. The display device used in the a portable information device has been required, compared to the conventional liquid crystal display device, to satisfy the further miniaturization and the further reduction of power consumption.

In using a battery or the like as a power source of the display device, it is necessary to reduce the power consumption which is brought about by the display. Accordingly, there has been proposed an idea to impart a memory function to each pixel of the conventional liquid crystal display device.

Japanese Patent Laid-open 2003-302946 (USP 7057596) discloses a liquid crystal display device in which a pixel includes two pairs of transistors for holding a video signal and an additional capacitor which is connected to a pixel electrode. A stored charge of an additional capacitor makes image signal which is written into the pixel electrode.

SUMMARY OF THE INVENTION

On the other hand, the display device is required to increase a transmissive aperture ratio. Further, the display device is also required to reduce the number of constituent elements with keeping a stable and reliable memory operation.

The present invention has been made to overcome the above-mentioned drawbacks of the related art and it is an object of the present invention to provide a technique which realizes an optimum driving circuit in a miniaturized display device.

The above-mentioned and other objects and novel features of the present invention will become apparent by the description of this specification and attached drawings.

To briefly explain the summary of typical inventions among inventions disclosed in this specification, they are as follows.

A display device forms pixel electrodes, switching elements which supply video signals to the pixel electrodes, a drive circuit which supplies a video signals to the switching elements, a driving circuit which outputs scanning signals, and a memory circuit which is provided to each pixel portion on the same substrate.

The memory circuit generates a voltage having an inverse polarity using a voltage which is held in a pixel electrode.

According to the present invention, a circuit size of a pixel memory can be reduced so that it is possible to save a space in laying out pixels. It is possible to realize both of an analog signal display and a memory display in combination thus reducing the circuit scale of the pixel memory whereby a multi-color pixel memory of 2 bits or more can be realized.

DESCRIPTION OF THE PREFERRED EMBODIMENTS

A liquid crystal display device includes pixel electrodes. The liquid crystal display device further includes first switching elements which supply video signals to the pixel electrodes, video signal lines which supply video signals to the first switching elements, scanning signal lines which supply scanning signals for controlling the first switching elements, inverters which are connected with first switching elements, first analogue switches which are arranged between the inverters and the pixel electrodes, and second analogue switches which are provided between the pixel electrodes and the inverters.

The video signals are held in the pixel electrodes by bringing the first switching elements into an ON state. The second analogue switches are brought into an ON state after bringing the first switching elements into an OFF state. While holding the first analogue switches in an OFF state, a voltage of the pixel electrodes is supplied to the inverters thus forming a voltage inverted with respect to the voltage held in the pixel electrodes. The AC driving of the liquid crystal display device is performed using the voltage held in the inside of the pixels.

Embodiments of the present invention are explained in detail in conjunction with drawings hereinafter. Here, in all drawings for explaining the embodiments, parts having identical functions are given same numerals and their repeated explanation is omitted.

Figure 1:
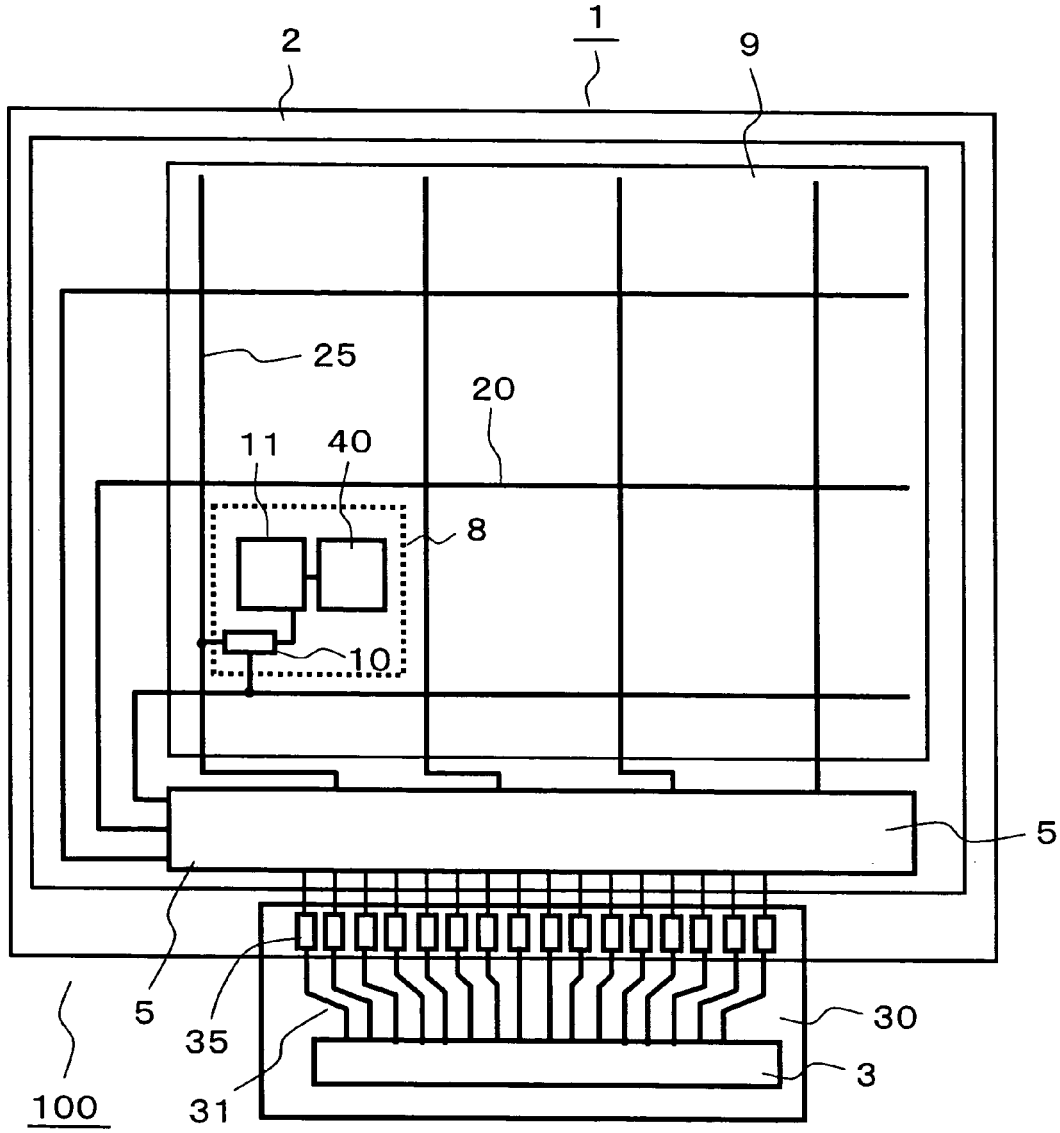
FIG. 1 is a schematic block diagram showing a liquid crystal display device of an embodiment of the present invention.

FIG. 1 is a block diagram showing the basic constitution of a liquid crystal display device of an embodiment of the present invention. As shown in the drawing, the liquid crystal display device 100 is constituted of a liquid crystal display panel 1 and a control circuit 3.

The liquid crystal display panel 1 includes an element substrate 2. The element substrate 2 made of a transparent glass, plastic or the like and a semiconductor substrate. On the element substrate 2, pixels 8 are arranged in a matrix array thus forming a display region 9. (In FIG. 1, only one pixel is described and other pixels are omitted so as to avoid the drawing from becoming complicated.) The pixel 8 includes a pixel electrode 11, a switching element 10 and a memory element 40.

On a periphery of the display region 9, a driving circuit part 5 is formed along an edge of the element substrate 2. The driving circuit part 5 is formed on the element substrate 2 by manufacturing steps substantially equal to manufacturing steps for forming switching elements 10.

Scanning signal lines 20 extend to the display region from the driving circuit part 5, and the scanning signal lines 20 are electrically connected with control terminals of the switching elements 10. Here, the driving circuit part 5 outputs a control signal (also referred to as a scanning signal) which turns on or off the switching elements 10 to the scanning signal lines 20.

Further, video signal lines 25 extend to the display region 9 from the driving circuit part 5 and are connected to input terminals of the switching elements 10. The video signal is outputted to the video signal lines 25 from the driving circuit part 5, and the video signal is written in the pixel electrodes 11 via the switching elements 10 which are brought into an ON-state by the scanning signal.

A flexible printed circuit board 30 is connected to the liquid crystal display panel 1, and the control circuit 3 is mounted on the flexible printed circuit board 30. The control circuit 3 has a function of controlling a driving circuit which is provided to the driving circuit part 5 and supplies the control signal, the video signal and the like to the liquid crystal display panel 1 via the flexible printed circuit board 30.

Display lines 31 are formed on the flexible printed circuit board 30 and are electrically connected with the display panel 1 via input terminals 35. A signal which controls the display panel 1 is supplied from the control circuit 3 via the display lines 31.

Figure 2:
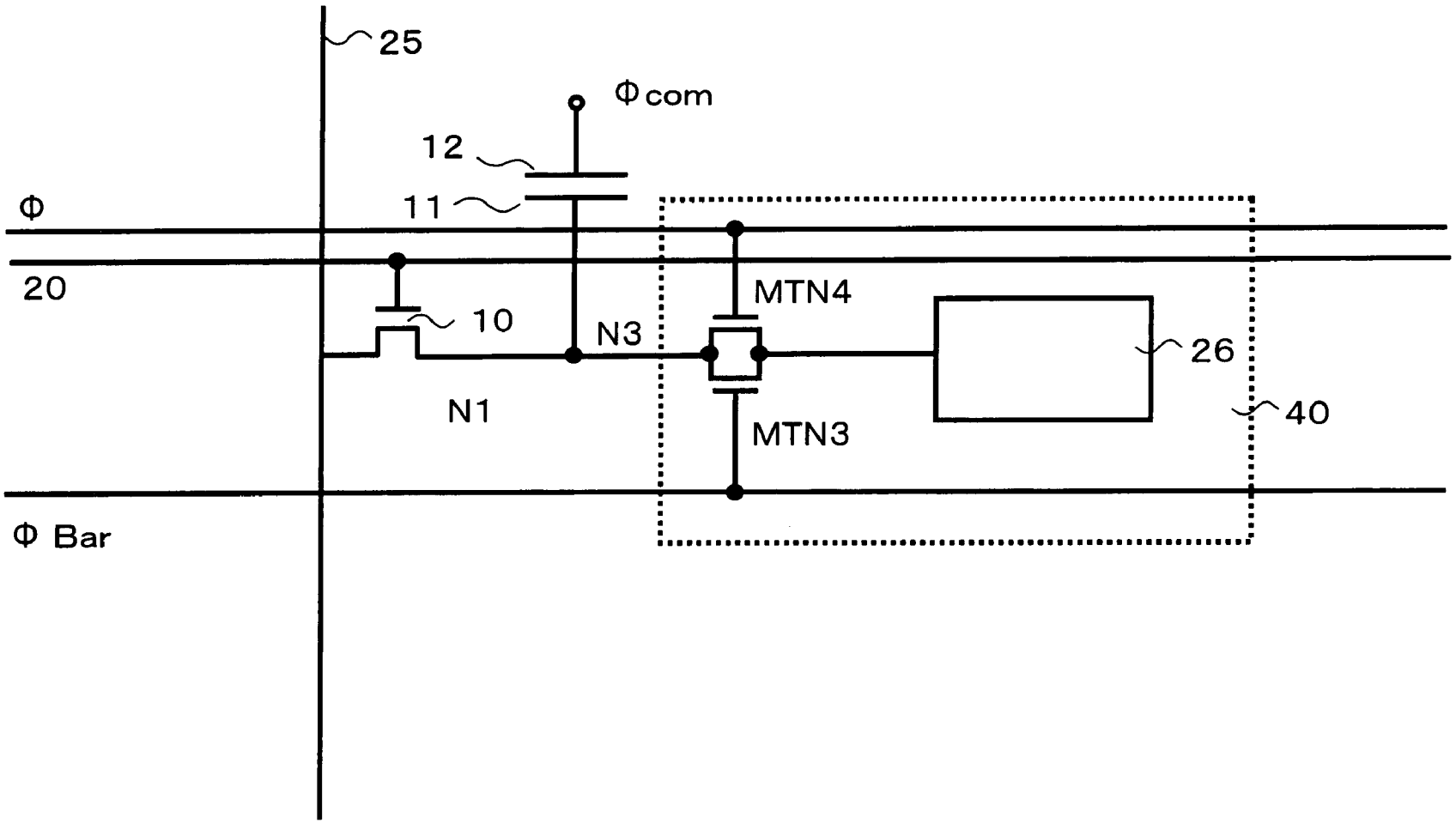
FIG. 2 is a schematic block diagram showing a pixel memory of the embodiment of the present invention.

Next, the switching element 10 and the memory element 40 which are provided to the pixel 8 are explained in conjunction with FIG. 2. In a small-sized portable information device such as a mobile phone, a battery is used as a power source in general. Accordingly, the display device is required to satisfy a demand for the reduction of power consumption.

FIG. 2 is a schematic block diagram showing the switching element 10 and the memory element 40 in each pixel. In FIG. 2, numeral 26 indicates a data holding element SRAM which holds data of 1 bit. A gray scale analogue voltage is supplied to the pixel 8 from the driving circuit part 5 shown in FIG. 1. The pixel 8 includes a sampling functional part which applies the gray scale analog voltage to the pixel electrode 11 via the switching element 10 and the memory element 40 which stores the 1 bit data to the data holding element SRAM and outputs a voltage corresponding to the stored 1 bit data to the pixel electrode 11.

With the provision of the memory element 40, it is possible to perform a display using the data which is held in the data holding element SRAM. For example, when the same image is continuously displayed as in the case of a standby screen of the mobile phone, it is unnecessary to rewrite the image by repeatedly transfer of data and the display can be performed by writing AC voltagesΦ, Φ bar for AC driving based on the held data thus saving the power for transferring data.

Figure 3:
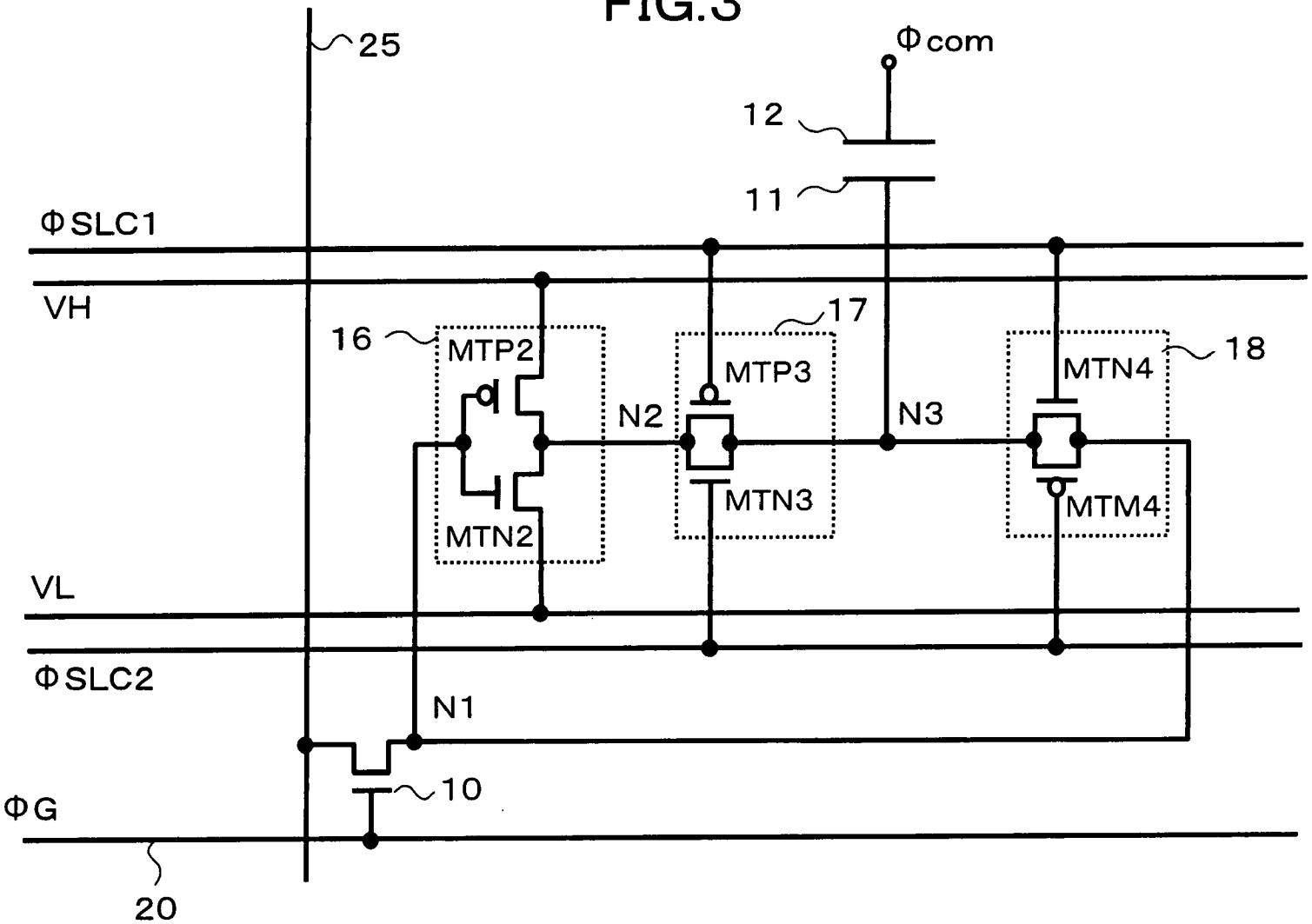
FIG. 3 is a schematic circuit diagram showing the pixel memory used in the liquid crystal display device of the embodiment of the present invention.

Next, FIG. 3 shows the circuit constitution of a unit pixel memory of the present invention. In the drawing, numeral 10 indicates the switching element and numeral 11 indicates the pixel electrode. To a counter electrode 12 which is arranged to face the pixel electrode 11 in an opposed manner, a clock pulse Φcom which periodically repeats a high level and a low level of the signal voltage is applied.

Turning on and off of the switching element 10 is controlled in response to a scanning signal ΦG of the scanning signal lines 20. FIG. 3 shows a case in which the switching element 10 is formed of an n-type transistor and hence, the switching element 10 assumes a conductive state when the scanning signal ΦG is at the high level and assumes a high resistance state when the scanning signal ΦG is at the low level. When the switching element 10 assumes the ON state, the video signal which is transmitted via the video signal line 25 is transmitted to a node N1.

In FIG. 3, there are provided two routes through which the video signal is transmitted to a pixel electrode 11 from the switching element 10. In one route, the video signal is inputted to an inverter circuit 16 which is constituted of CMOS transistors (MTP2, MTN2) via the node N1 and is transmitted to the node N3, to the pixel electrode 11 via the node N2 and an analogue switch 17. In another route, the video signal is transmitted to the node N3, the pixel electrode 11 via the node N1 and an analogue switch 18.

To the inverter circuit 16 which is constituted of the CMOS transistors, a high-level voltage VH and a low-level voltage LH are inputted as a power source. Although the inverter circuit 16 outputs a voltage having a polarity opposite to a polarity of the input signal, for example, when a signal of low level is inputted to the node N1, the high-level voltage VH is supplied to the node N2.

Between the node N2 and the node N3, an analog switch 17 is provided and the turning on or off of the analogue switch 17 is controlled based on control pulses ΦSLC1, ΦSLC2. Between the node N3 and the node N1, an analog switch 18 is provided and the turning on or off of the analogue switch 18 is controlled based on the same control pulses ΦSLC1, ΦSLC2.

The analog switch 17 is constituted of an n-type transistor MTN3 and a p-type transistor MTP3. The analog switch 18 is constituted of an n-type transistor MTN4 and a p-type transistor MTP4. When the analog switch 17 and the analog switch 18 assume an ON state in response to the control pulses ΦSLC1, ΦSLC2, the analog switch 17 and the analog switch 18 exhibit the low resistance and can transmit the signal in two directions. To take the analogue switch 18 as an example, when the analog switch 18 assumes an ON state, due to voltages at the node N1 and the node N3, it is possible to transmit the signal from the node N1 to the node N3 as well as from the node N3 to the node N1.

A display mode of the pixel, that is, a white display or a black display is determined based on whether the voltage of the node N3 which is connected to the pixel electrode 11 has the same polarity with or the polarity opposite to the polarity of the voltage of a clock pulse Φcom which is applied to the counter electrode 12. In a normally black mode, when the voltage of the node N3 has the same polarity with the voltage of the clock pulse Φcom, the pixel performs the black display, while when the voltage of the node N3 has the polarity opposite to the polarity of the voltage of the clock pulse Φcom, the pixel performs the white display.

Here, although the display mode in a normally white mode becomes opposite to the display mode in a normally black mode, in this embodiment, the explanation is made on the premise that the display mode is the normally black mode. Further, in this embodiment, although the explanation is made with respect to a so-called common AC system which applies a clock pulse which inverts the polarity thereof for every one screen (one frame) to the counter electrode 12, the present invention is also applicable to a case in which a fixed voltage is applied to the counter electrode 12 in the same manner.

Hereinafter, the manner of operation of the circuit shown in FIG. 3 is explained in conjunction with a timing chart shown in FIG. 4. First of all, before a point of time t3 shown in FIG. 4, the voltage of the node N3 assumes a low level, and the clock pulse Φcom assumes a high level. The voltage of the pixel electrode 11 assumes a low level and the voltage of the counter electrode 12 assumes a high level and hence, the pixel electrode 11 and the counter electrode 12 exhibit polarities opposite to each other whereby the white display is performed.

When the pulse ΦSLC1 is changed from the low level to the high level and the pulse ΦSLC2 is changed from the high level to the low level at a point of time t3, the analogue switch 17 between the node N2 and the node N3 shown in FIG. 3 assumes an OFF state and the analogue switch 18 between the node N3 and the node N1 shown in FIG. 3 assumes an ON state. It is possible to design the circuit such that the liquid crystal capacity between the pixel electrode 11 and the counter electrode 12 is set sufficiently larger than the capacity of the node N1. In this case, the potential of the node of the node N1 is changed to the low level in the same manner as the potential of the node N3 at timing of a point of time t3. At this point of time, the potential of the node N2 is changed from the low level to the high level.

When the pulse ΦSLC1 is changed from the high level to the low level and the pulse ΦSLC2 is changed from the high level to the low level at a point of time t4, the analogue switch 17 between the node N2 and the node N3 shown in FIG. 3 assumes an ON state and the analogue switch 18 between the node N3 and the node N1 shown in FIG. 3 assumes an OFF state. The node N3 assumes the high level in the same manner as the node N2 via the inverter 16.

Since the clock pulse Φcom is changed from the high level to the low level before the point of time t4, as mentioned previously, the potential of the node N3 assumes the potential having polarity opposite to the polarity of the clock pulse Φcom and hence, the white display is continued.

At a point of time t5, the scanning signal line 20 is changed from the low level to the high level and hence, the switching element 10 assumes an ON state. Here, assume that the drain line is set to the high level (having the same polarity as the clock pulse Φcom and performing the black display) in response to the digital signal. The node N1 is changed from the low level to the high level. Since an output of the inverter 12 assumes the low level, the node N2 and the node N3 assume the low level. Here, since the clock pulse Φcom is set at the low level, an electric field applied to such liquid crystal capacity is changed to 0V thus changing the white display to the black display.

When the pulse ΦSLC1 is changed from the low level to the high level and the pulse ΦSLC2 is changed from the high level to the low level at a point of time t7, the analogue switch 17 between the node N2 and the node N3 assumes an OFF state and the analogue switch 18 between the node N3 and the node N1 assumes an ON state. At the timing of point of time t7, the potential of the node of the node N1 is changed to the low level in the same manner as the potential of the node N3. At this point of time, the potential of the node N2 is changed from the low level to the high level.

When the pulse ΦSLC1 is changed from the high level to the low level and the pulse ΦSLC2 is changed from the low level to the high level at a point of time t8, the analogue switch 17 between the node N2 and the node N3 assumes an ON state and the analogue switch 18 between the node N3 and the node N1 assumes an OFF state. The node N3 assumes the high level in the same manner as the node N2 via the inverter 16.

Since the clock pulse Φcom is changed from the low level to the high level before the point of time t8, as mentioned previously, the potential of the node N3 assumes the potential having the same polarity as the potential of the clock pulse Φcom and hence, the black display is continued thus enabling the use of a voltage inversion method for driving the liquid crystal.

When the pulse ΦSLC1 is changed from the low level to the high level and the pulse ΦSLC2 is changed from the low level to the high level at a point of time t9, the analogue switch 17 between the node N2 and the node N3 assumes an OFF state and the analogue switch 18 between the node N3 and the node N1 assumes an ON state. At the timing of point of time t9, the potential of the node of the node N1 is changed to the high level in the same manner as the potential of the node N3. At this point of time, the potential of the node N2 is changed from the high level to the low level.

When the pulse ΦSLC1 is changed from the high level to the low level and the pulse ΦSLC2 is changed from the low level to the high level at a point of time t10, the analogue switch 17 between the node N2 and the node N3 assumes an ON state and the analogue switch 18 between the node N3 and the node N1 assumes an OFF state. Further, the node N3 assumes the low level in the same manner as the node N2 via the inverter 16.

Before the point of time t10, the clock pulse Φcom is changed from the high level to the low level and hence, as the result of the above-mentioned manner of operation, the potential of the node N3 assumes the potential having the same polarity as the potential of the clock pulse Φcom whereby the black display is continued and the AC driving can be performed.

Hereinafter, unless new signals are written in the circuit, the above-mentioned respective states are repeated and a memory state can be maintained and the display can be made while also performing the AC driving.

Figure 5:
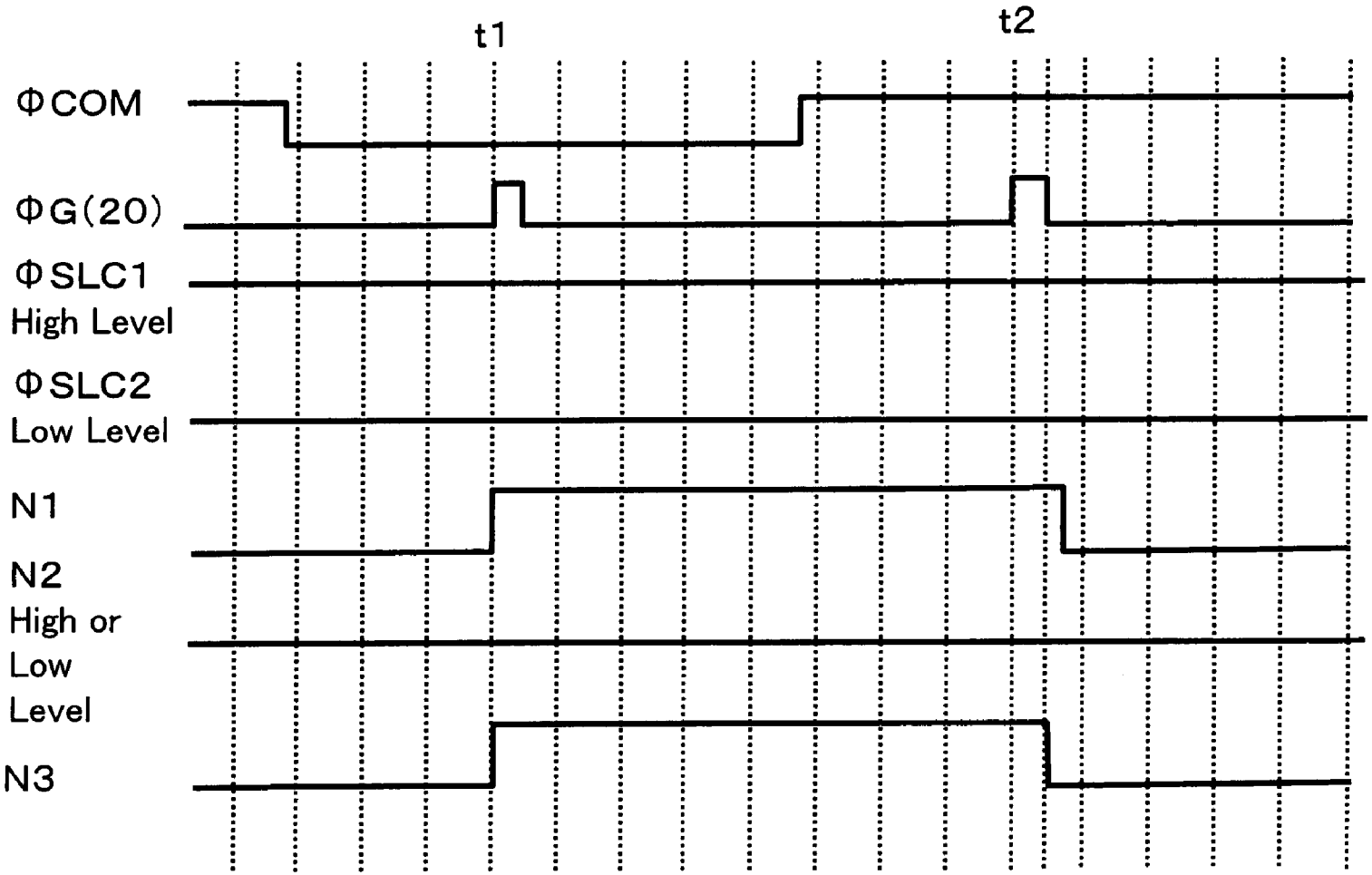
FIG. 5 is a timing chart showing the manner of operation of the embodiment of the present invention.

FIG. 5 shows a timing chart in case of an analogue signal display. In performing the analogue signal display, a high-level voltage VH and a low level voltage VL which constitute a power source for operating a memory are set to the same potential. This provision is made to prevent a through current from flowing into the inverter 16 whatever voltage the node N1 which is the gate voltage of the inverter 16 assumes. Although the voltage may be arbitrarily set provided that the high-level voltage VH and the low-level voltage VL assume the same potential, the voltage is set to the low level in this embodiment.

The control pulse ΦSLC1 is fixed to a high level and the control pulse ΦSLC2 is fixed to a low level. That is, the node N2 and the node N3 are interrupted from each other, while the node N1 and the node N3 are connected with each other. When the scanning signal ΦG is changed from the low level to the high level at a point of time t1 shown in FIG. 5, the switching element 10 which constitutes a pixel transistor assumes an ON state, and an analogue voltage is supplied to the nodes N1 and N3 from the video signal line 25. Accordingly, it is possible to supply the analogue voltage to the pixel electrode 11 in the same manner as the usual display operation.

Figure 6:
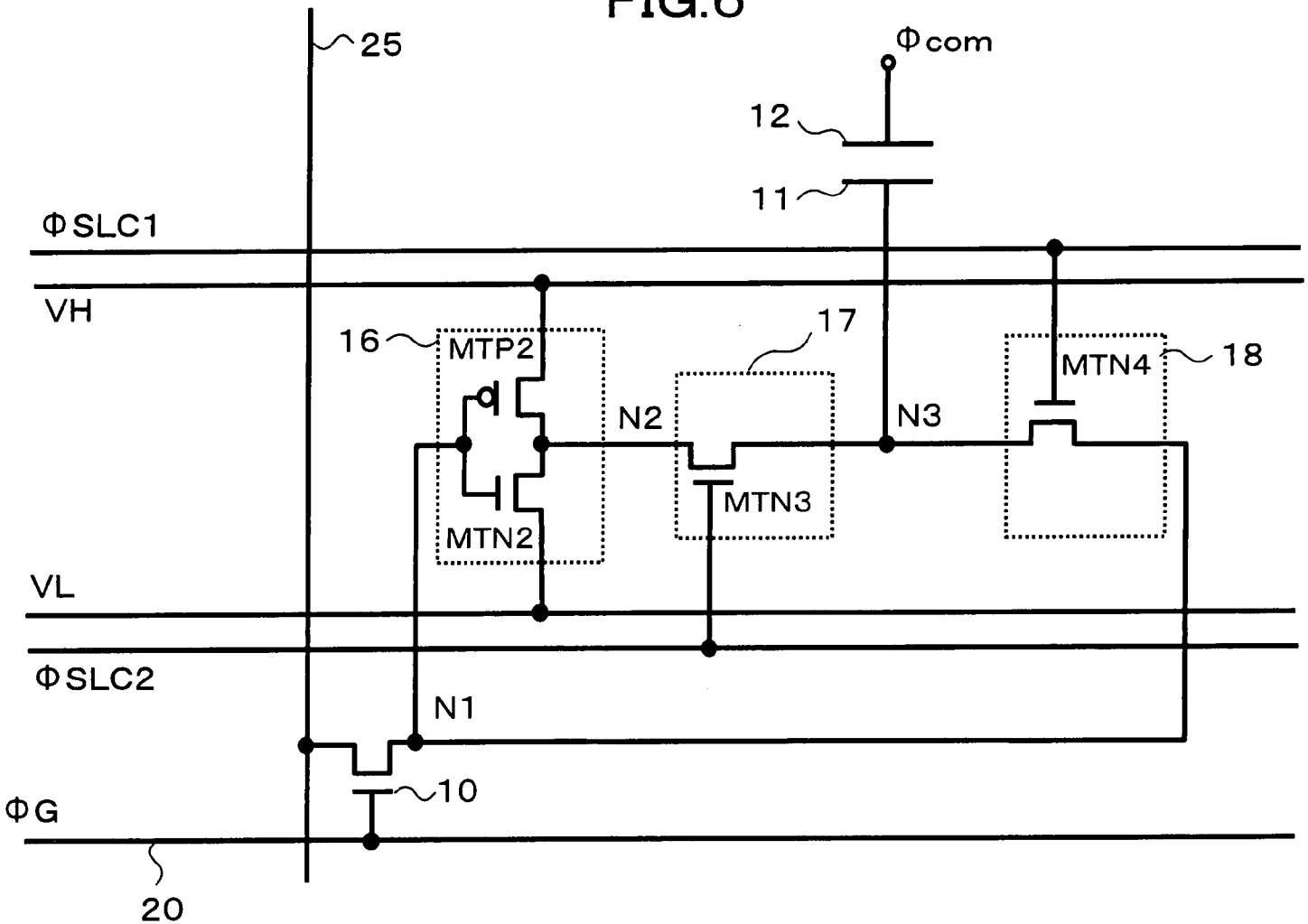
FIG. 6 is a schematic block diagram showing a pixel memory used in the liquid crystal display device of another embodiment of the present invention.

FIG. 6 is a schematic view showing a pixel memory used in a liquid crystal display device of this embodiment, wherein the analogue switch 17 shown in FIG. 3 is constituted of an n-type transistor MTN3 and the analogue switch 18 shown in FIG. 3 is constituted of an n-type transistor MTN4. With the driving method shown in FIG. 4 and FIG. 5, this embodiment can perform the memory operation and the analogue signal display.

In the circuit shown in FIG. 6, it is unnecessary to form contact portions which connect the n-type transistors and the p-type transistors of the analogue switches 17, 18 and hence, it is possible to reduce a layout area of the pixel portion.

Figure 4:
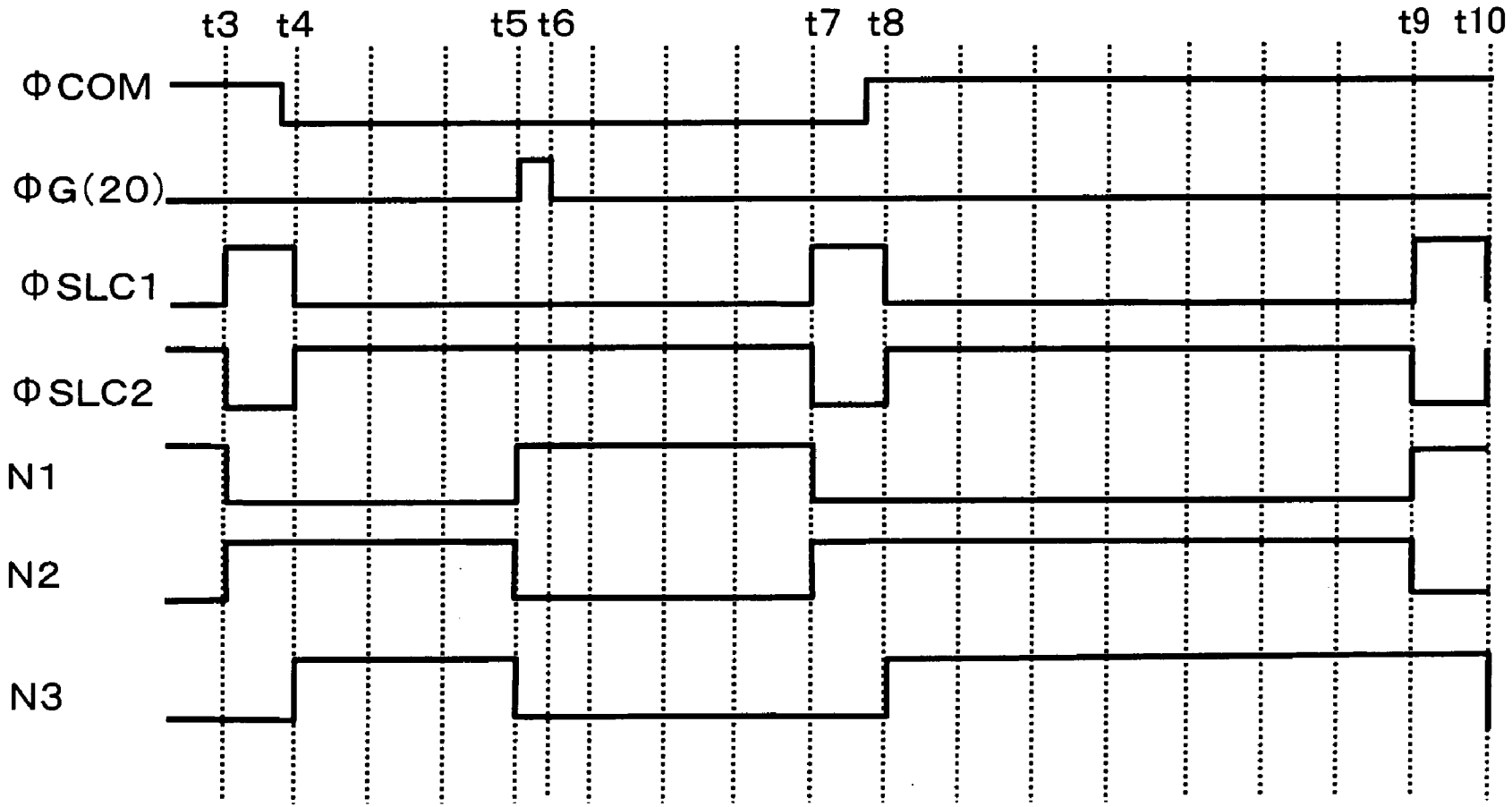
FIG. 4 is a timing chart showing the manner of operation of the embodiment of the present invention.
Figure 7:
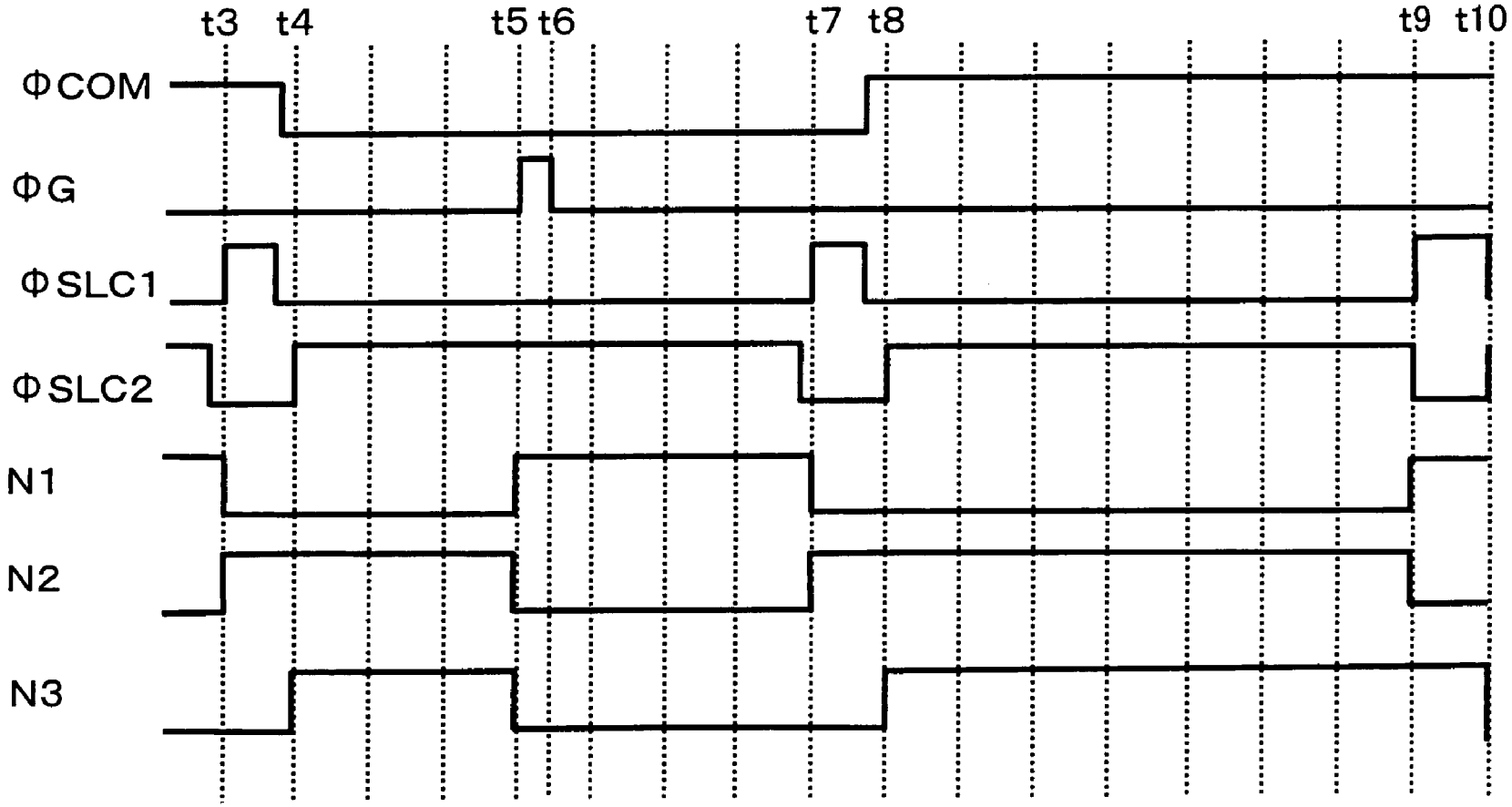
FIG. 7 is a timing chart showing the manner of operation of the embodiment of the present invention.

Here, although the control pulses ΦSLC1, ΦSLC2 may be operated at the timing shown in FIG. 4 in performing the memory operation, it is preferable to drive the control pulses ΦSLC1, ΦSLC2 at timing as shown in FIG. 7 in a state that the control pulses ΦSLC1 is set to the high level after setting the control pulses ΦSLC2 to the low level thus preventing a possibility that both of the analogue switches 17, 18 assume an ON state simultaneously. Here, by setting the high level of the control pulses ΦSLC1, ΦSLC2 to VH+Vth or more which is a voltage obtained by adding a voltage corresponding to a threshold value Vth of each n-type transistor MTN3, MTN4 to the high level voltage VH, it is possible to perform the operation while suppressing the decrease of the voltage attributed to the threshold value.

Figure 8:
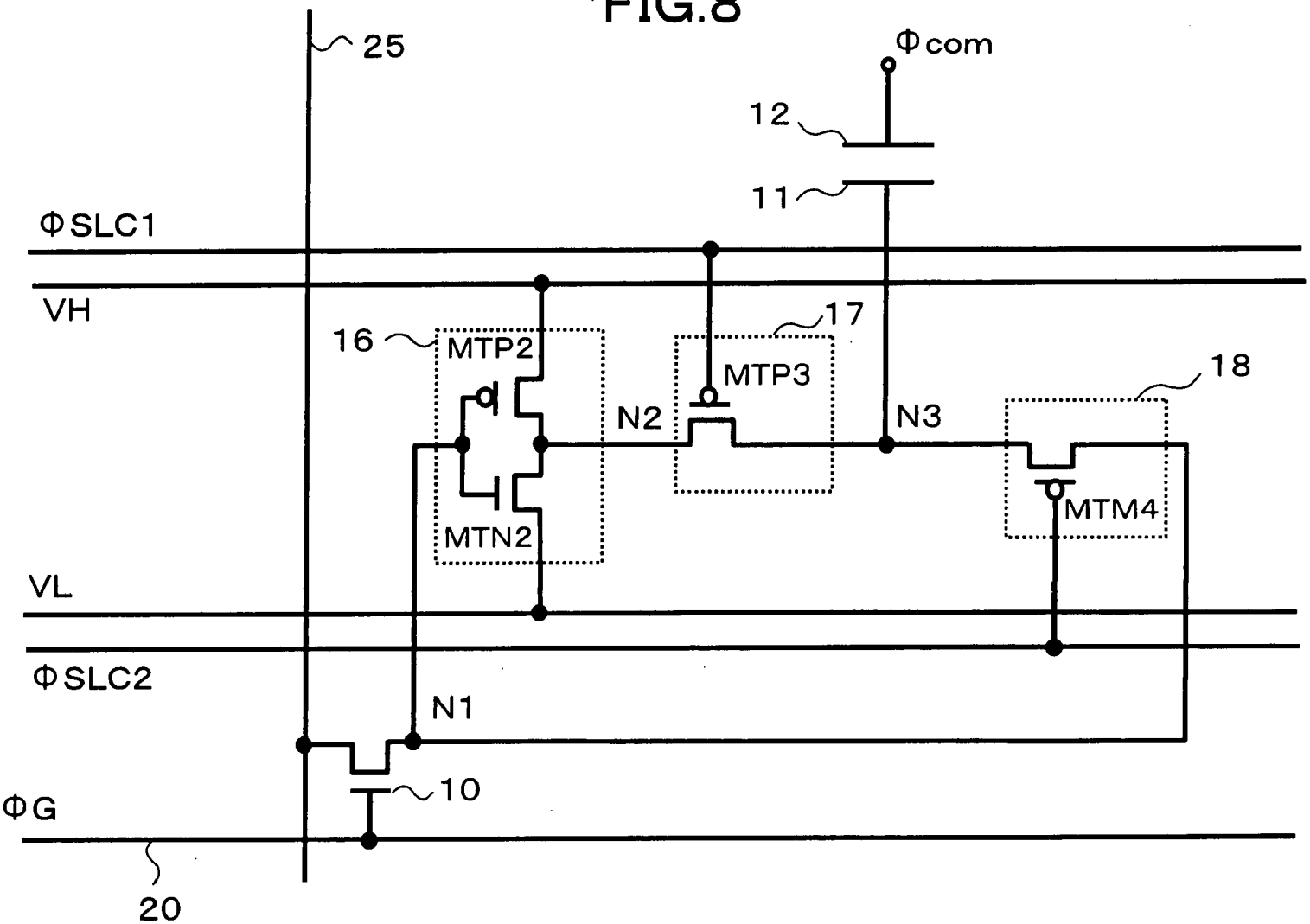
FIG. 8 is a schematic block diagram showing a pixel memory used in the liquid crystal display device of the embodiment of the present invention.

FIG. 8 is a schematic view showing a pixel memory used in a liquid crystal display device of this embodiment, wherein the analogue switch 17 shown in FIG. 3 is constituted of a p-type transistor MTP3 and the analogue switch 18 shown in FIG. 3 is constituted of a p-type transistor MTP4. With the driving method shown in FIG. 4 and FIG. 5, this embodiment can perform the memory operation and the analogue signal display.

Also in the circuit shown in FIG. 8, it is unnecessary to form contact portions which connect the n-type transistors and the p-type transistors of the analogue switches 17, 18 and hence, it is possible to reduce a layout area of the pixel portion.

Figure 9:
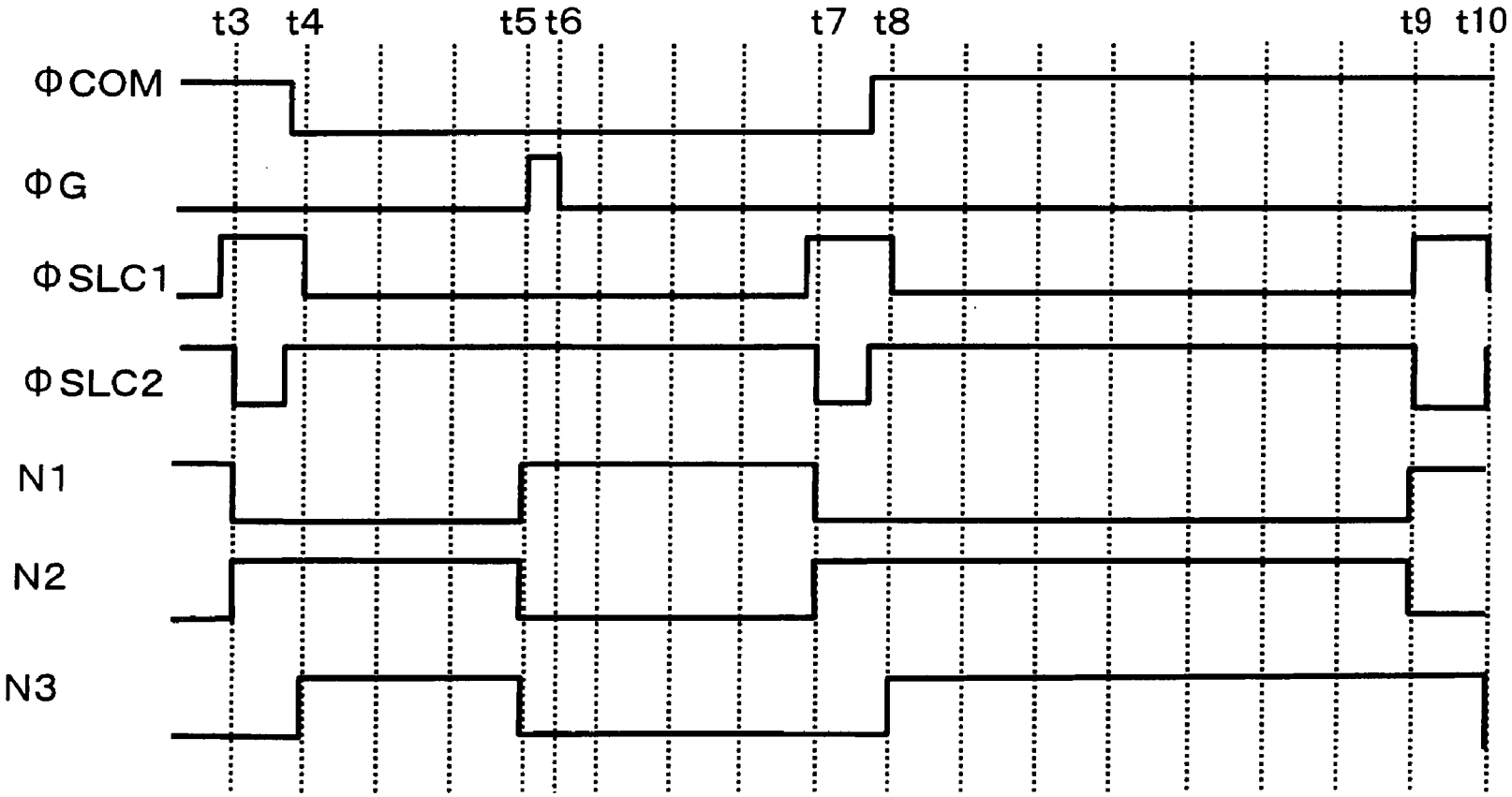
FIG. 9 is a timing chart showing the manner of operation of the embodiment of the present invention.

Here, although the control pulses ΦSLC1, ΦSLC2 may be operated at the timing shown in FIG. 4 during the memory operation, it is preferable to drive the control pulses ΦSLC1, ΦSLC2 at timing as shown in FIG. 9 in a state that the control pulse ΦSLC2 is set to the low level after setting the control pulse ΦSLC1 to the high level thus preventing a possibility that both of the analogue switches 17, 18 assume an ON state simultaneously. Here, by setting the low level of the control pulses ΦSLC1, ΦSLC2 to VH−Vth or more which is a voltage obtained by subtracting a voltage corresponding to a threshold value Vth of each p-type transistor MTP3, MTP4 from the low level voltage VL, it is possible to perform the operation while suppressing the decrease of the voltage attributed to the threshold value.

Figure 10:
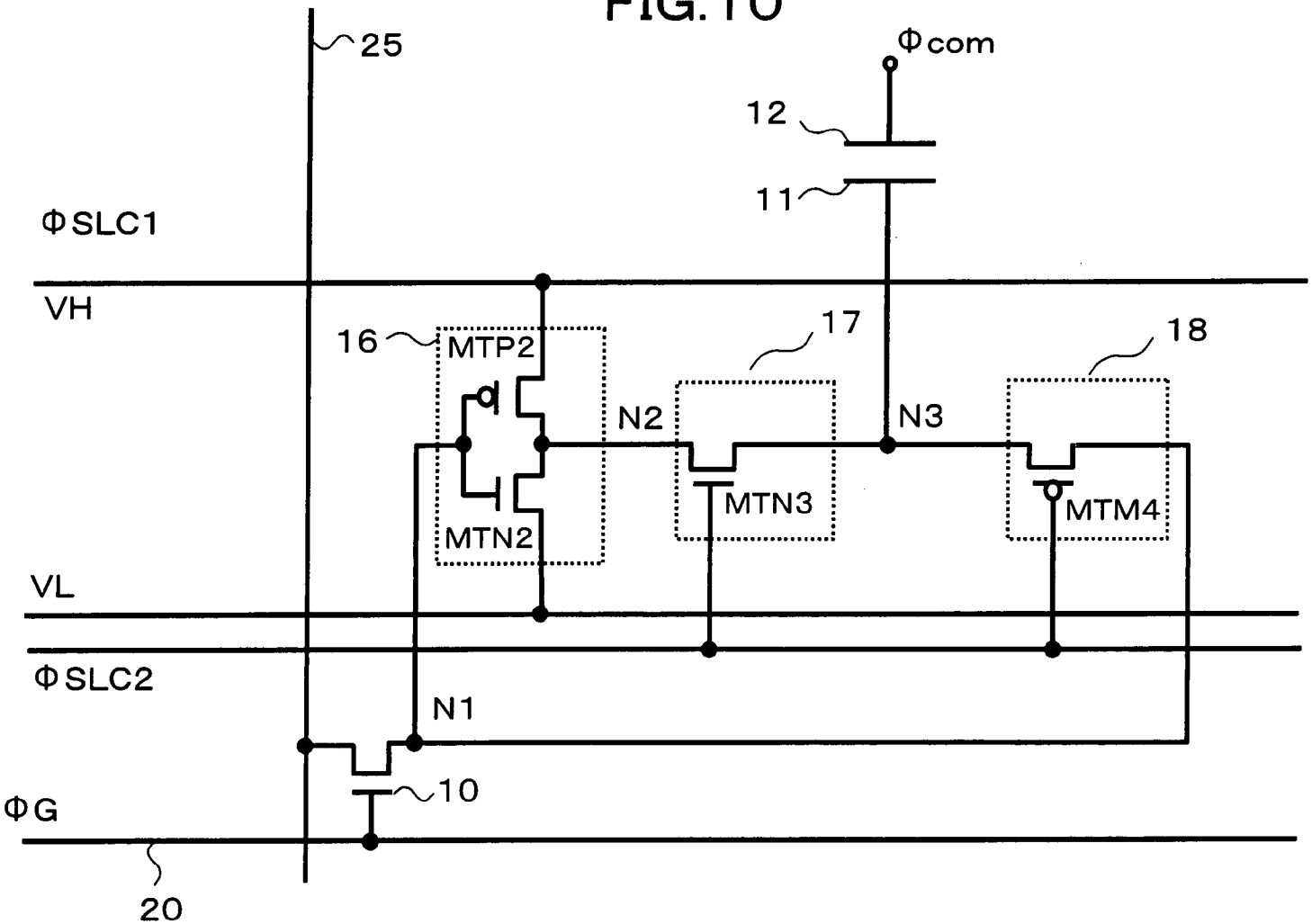
FIG. 10 is a schematic block diagram showing a pixel memory used for a liquid crystal display device of another embodiment of the present invention.

FIG. 10 is a schematic view showing a pixel memory used in a liquid crystal display device of this embodiment, wherein the analogue switch 17 shown in FIG. 3 is constituted of an n-type transistor MTN3 and the analogue switch 18 shown in FIG. 3 is constituted of a p-type transistor MTP4. With the driving method shown in FIG. 4 and FIG. 5, this embodiment can perform the memory operation and the analogue signal display.

Also in the circuit shown in FIG. 10, it is unnecessary to form contact portions which connect the n-type transistors and the p-type transistors of the analogue switches 17, 18 and hence, it is possible to reduce a layout area of the pixel portion. Further, it is possible to control the analogue switches 17, 18 with the control pulse ΦSLC2 or the control pulse ΦSLC1 and hence, signal lines for control pulses can be formed into one signal line whereby this embodiment is advantageous with respect to the layout of the pixel portion.

Figure 11:
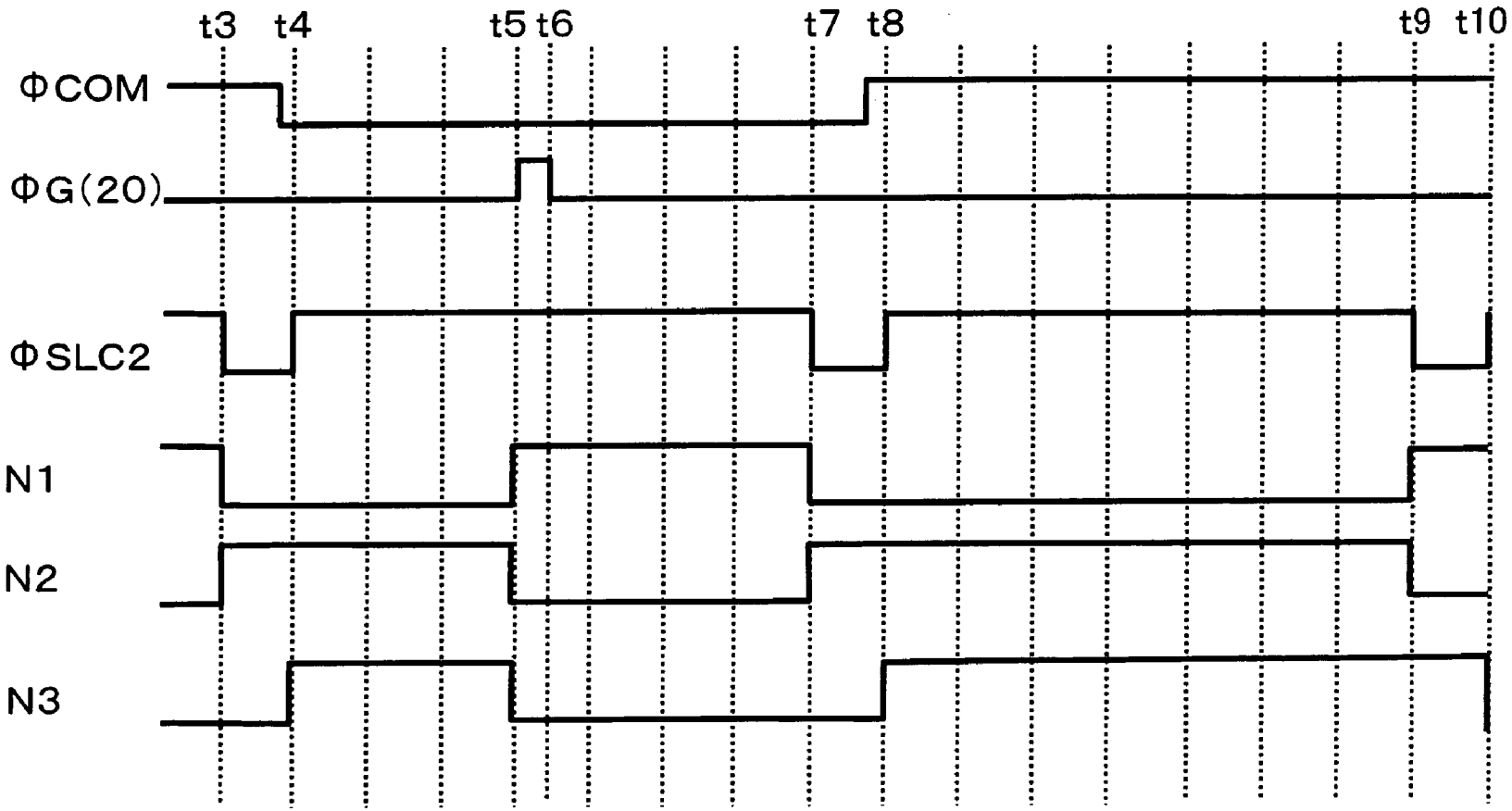
FIG. 11 is a timing chart showing the manner of operation of the embodiment of the present invention.

Here, although the control pulses ΦSLC1, ΦSLC2 may be operated at the timing shown in FIG. 4 in performing the memory operation, the memory operation may be performed using only the control pulse ΦSLC2 as shown in FIG. 11.

Figure 12:
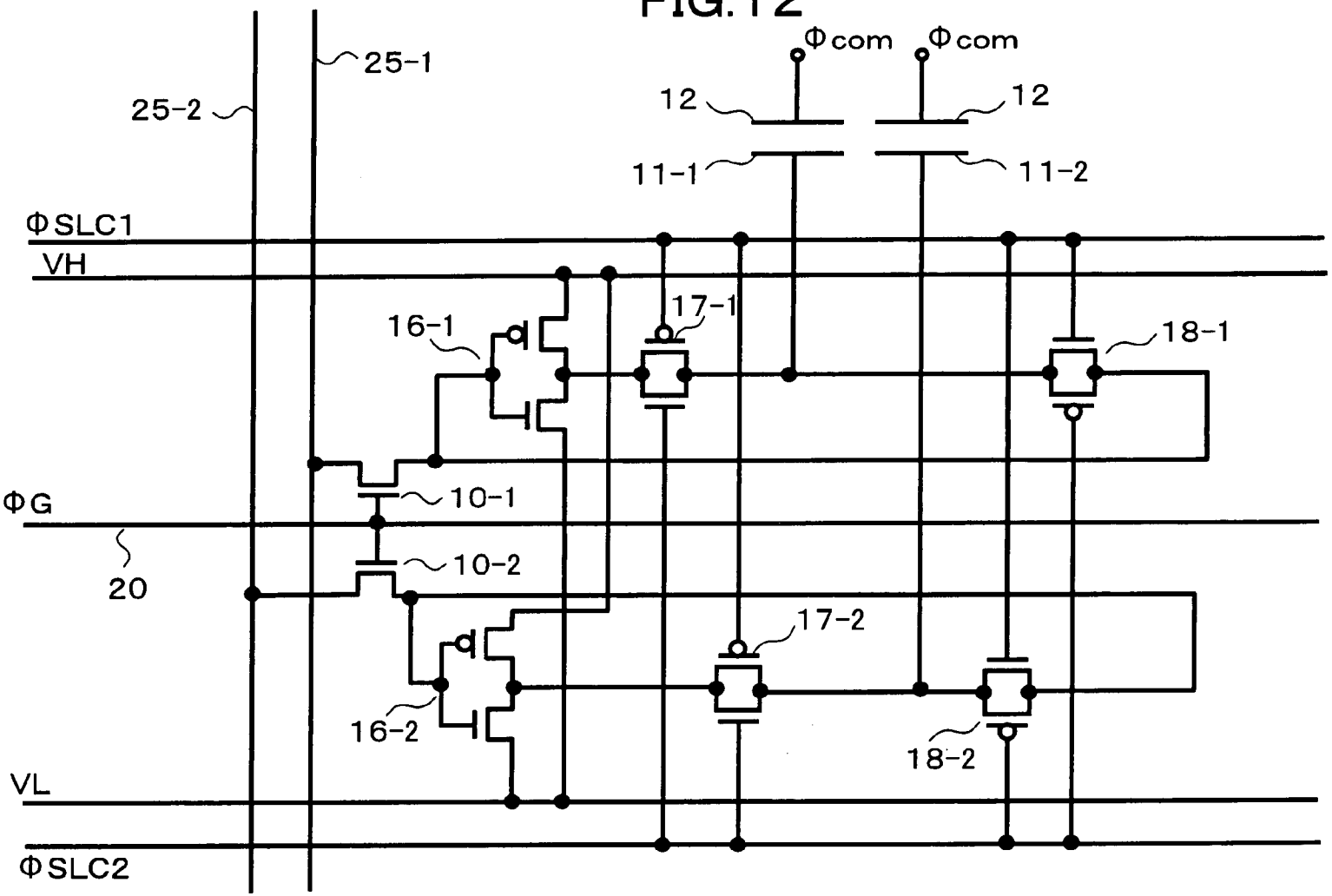
FIG. 12 is a schematic block diagram showing a pixel memory used in a liquid crystal display device of another embodiment of the present invention.

FIG. 12 is a schematic view showing a pixel memory used in the liquid crystal display device of this embodiment, wherein two pixel electrodes 11 are formed in one pixel and a pixel electrode 11-2 is formed with an area twice as large as an area of the pixel electrode 11-1. In one pixel, a switching element 10-1, an inverter 16-1 and analogue switches 17-1, 18-1 for the pixel electrode 11-1 and a switching element 10-2, an inverter 16-2 and analogue switches 17-2, 18-2 for the pixel electrode 11-2 are formed.

The circuit includes video signal lines 25-1, 25-2 which supply a signal for operating a memory to respective pixel electrodes 11-1, 11-2. Here, when the signal for operating the memory is used in a time-division mode, it is possible to allow each pixel to posses one video signal line 25 and one switching element 10.

Figure 13:
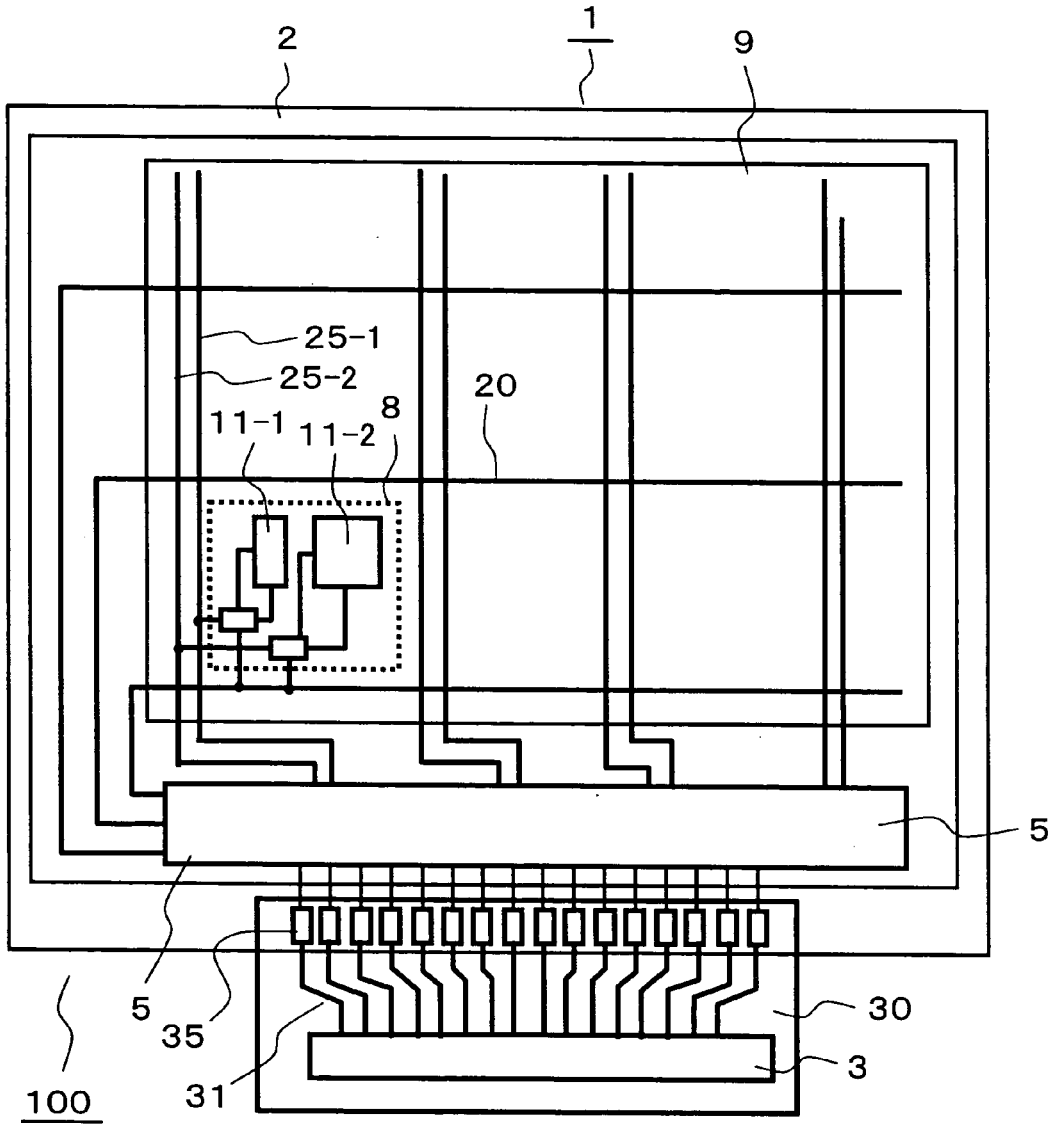
FIG. 13 is a schematic block diagram showing a liquid crystal display device of an embodiment of the present invention.

FIG. 13 is a schematic plan view of a liquid crystal display panel in which each pixel includes a pixel electrode 11-1, and a pixel electrode 11-2 which has an area twice as large as an area of the pixel electrode 11-1. Although the case in which two pixel electrodes are formed in one pixel is shown in FIG. 13, a pixel electrode having an area four times as large as the area of the pixel electrode 11-1 may be provided thus forming three pixel electrodes in one pixel. The number of pixel electrodes may be increased more. That is, a pixel electrode having an area eight times as large as the area of the pixel electrode 11-1 may be provided thus forming four pixel electrodes in one pixel.

The circuit shown in FIG. 12 may perform the memory operation and the analogue signal display using the driving method shown in FIG. 4 and FIG. 5. By allowing both of the pixel electrodes 11-1, 11-2 to perform a black display, a gray scale 0 may be expressed. By allowing the pixel electrode 11-1 to perform a white display and the pixel electrode 11-2 to perform a black display, a gray scale 1 may be expressed. By allowing the pixel electrode 11-1 to perform a black display and the pixel electrode 11-2 to perform a white display, a gray scale 2 may be expressed. Further, by allowing the pixel electrode 11-1 to perform a white display and the pixel electrode 11-2 to perform a white display, a gray scale 3 may be expressed.

According to this embodiment, the gray scale data of 2 bits is held in the pixel memory and hence, it is possible to perform the AC driving without performing the rewriting via the video signal line 25. Further, a layout area necessary for the pixel memory can be suppressed to a small value and hence, it is possible to acquire a high numerical aperture while using a pixel memory of large bits.

What is claimed is:

1. A display device comprising:

a first substrate;

a second substrate;

a plurality of pixel electrodes formed on the first substrate;

a first switching element supplying a video signal to the pixel electrode;

a video signal line supplying a video signal to the first switching element; and a scanning signal line supplying a scanning signal which controls the first switching element, wherein an inverter circuit electrically connects between the switching element and the pixel electrode and inverts a voltage of the pixel electrode by a voltage held in the pixel electrode before inverting, a second switching element electrically connects between an output of the inverter circuit and the pixel electrode, a third switching element electrically connects between the pixel electrode and an input of the inverter circuit, the third switching element electrically connects the first switching element and the pixel electrode, the video signal is supplied by the first switching element and the third switching element to the pixel electrode, the voltage of the pixel electrode is transmitted from the pixel electrode to the inverter circuit through the third switching element when the third switching element is in an on state and the second switching element is in an off state, the second switching element includes a parallel-connected N-type transistor and a P-type transistor, and the third switching element includes a parallel-connected N-type transistor and a P-type transistor.

2. A display device according to claim 1, wherein the inverter circuit includes a series-connected N-type transistor and P-type transistor.

3. A display device comprising:

a first substrate;

a second substrate;

a plurality of pixel electrodes which are formed on the first substrate;

a counter electrode which is arranged to face the pixel electrodes;

a first switching element which supplies a video signal to the pixel electrode;

a video signal line which supplies a video signal to the first switching element;

a scanning signal line which supplies a scanning signal which controls the first switching element;

a signal inverting element which is electrically connected with the first switching element;

a second switching element which is provided between the signal inverting element and the pixel electrode; and a third switching element which is provided between the pixel electrode and the signal inverting element, wherein a voltage of the pixel electrode is supplied to the signal inverting element via the third switching element;

the third switching element electrically connects between the first switching element and the pixel electrode;

the video signal is supplied by the first switching element and the third switching element to the pixel electrode, the signal inverting element outputs a signal voltage having polarity opposite to polarity of the video signal held in the pixel electrode before inverting, the voltage of the pixel electrode is transmitted from the pixel electrode to the signal inverting element through the third switching element when the third switching element is in an on state and the second switching element is in an off state, the second switching element includes a parallel-connected N-type transistor and a P-type transistor, and the third switching element includes a parallel-connected N-type transistor and a P-type transistor.

4. A display device according to claim 2, wherein the inverting element includes a series-connected N-type transistor and P-type transistor.

5. A display device comprising:

a first substrate;

a second substrate;

a plurality of pixel electrodes which are formed on the first substrate;

a counter electrode which is arranged to face the pixel electrodes;

a first switching element which supplies a video signal to the pixel electrode;

a video signal line which supplies a video signal to the first switching element;

a scanning signal line which supplies a scanning signal which controls the first switching element;

an inverter which is connected with the first switching element;

a first analogue switch which is provided between an input of the inverter and the pixel electrode; and a second analogue switch which is provided between the pixel electrode and an output of the inverter, wherein the video signal is held by the pixel electrode after the first switching element turned off, a voltage of the pixel electrode is supplied to the inverter by turning on the second analogue switch and by turning off the first analogue switch;

the second analogue switch electrically connects between the first switching element and the pixel electrode;

the video signal is supplied by the first switching element and the second analogue switch to the pixel electrode, the inverter forms a voltage which is inverted with respect to a voltage held in the pixel electrode before inverting, the first analogue switch includes a parallel-connected N-type transistor and a P-type transistor, and the second analogue switch includes a parallel-connected N-type transistor and a P-type transistor.

6. A display device according to claim 5, wherein the inverter circuit includes a series-connected N-type transistor and P-type transistor.

* * * * *